United States Patent [19]

Nelson

[11] 4,228,818

[45] Oct. 21, 1980

[54] CROSSOVER RELIEF VALVE

[75] Inventor: David J. Nelson, Bloomington, Minn.

[73] Assignee: Victor Fluid Power, Eden Prairie, Minn.

[21] Appl. No.: 901,597

[22] Filed: May 1, 1978

[51] Int. Cl.[3] ..... F15B 11/16

[52] U.S. Cl. ..... 137/115; 91/437; 137/493

[58] Field of Search ..... 137/115, 493, 118; 91/437, 512, 515

[56] References Cited

U.S. PATENT DOCUMENTS 2,500,627 3/1950 Chinn ..... 137/118

FOREIGN PATENT DOCUMENTS 46-30883 of 1971 Japan ..... 91/437

*Primary Examiner*—Robert G. Nilson

*Attorney, Agent, or Firm*—Douglas L. Carlsen; Michael E. Kiteck, Jr.

[57] ABSTRACT

A crossover relief valve for use in a hydraulic circuit connected to two single acting cylinders such as used to provide rearward force against opposite ends of a plow blade wherein excessive pressure against one end of the blade will allow fluid to flow from one cylinder to the other, the valve being of the sliding poppet and port type wherein the poppet has surface areas exposed to the pressure line to each cylinder of such a size as to open the valve for flow between cylinders when excessive pressure is applied to either and wherein when pressure is applied from both pressure lines against said surface areas the poppet will move a sufficient distance to open a port for return of hydraulic fluid to a reservoir.

4 Claims, 4 Drawing Figures

CROSSOVER RELIEF VALVE

BACKGROUND OF THE INVENTION

This invention pertains generally to spring loaded relief valves used in hydraulic systems. More particularly the invention relates to such valves which are used to equalize the pressure between two single acting hydraulic jacks such as used in backing support for a snowplow blade or the like.

Valves of this general type are frequently referred to as "crossover" valves. For instance, in a plow application where two jacks are used as backing support for opposite ends of the plow and one end of the plow encounters an obstruction to cause contracting pressure on the jack at that end, the valve will be forced open to allow fluid to flow from the contracting jack into the cylinder of the other jack. This is a normal operation as the plow is generally pivoted at a central point to a motive power frame whereby upon contraction of one jack the other jack will be in an extending condition and thus receptive to additional fluid.

However, in certain conditions when one or both ends of the plow blade encounter heavy resistance, a retracting cylinder may exhaust more fluid than the other cylinder can accept. This may create excessive pressure in one or both cylinders and the fluid lines leading thereto with resultant damage to the hydraulic system.

SUMMARY OF THE INVENTION

It is the primary object of the present invention to provide a crossover valve for use in a hydraulic system having two single acting cylinders which will automatically dump fluid to the system reservoir when contracting pressure on one cylinder is such as to exhaust more fluid from such cylinder than the other cylinder will accept through the valve.

Another object of the invention is to provide a crossover valve of the type having a single sliding piston which controls both the crossover flow between two cylinders and the flow of excess fluid to the reservoir when the pressures so demand.

Still another object of the invention is to provide a spring tensioned piston type crossover valve for use in a hydraulic system having two single acting cylinders which valve controls both crossover flow of fluid between the cylinders and release of fluid to the system reservoir and which has means for readily adjusting the spring tension on the piston to adapt the valve to various applications.

With the above and various other objects in view the invention broadly comprises a valve body having a passageway extending axially therethrough, the housing being provided with first, second and third prots spaced axially therealong and having open communication with the passageway, a piston slidably mounted in the passageway, spring means acting between the housing and piston to yieldably retain the piston in a position closing all of said ports but yielding under limited pressure on the piston to allow the piston to slide to a position where the first and second ports are open to each other and yielding further under excessive pressure on the piston to allow the piston to slide to a position where the first and second ports are also open to the third port. Means are also provided for adjusting the retention strength of the spring means.

DESCRIPTION OF THE PREFERRED EMBODIMENT

Figures 1, 2, 3, 4:
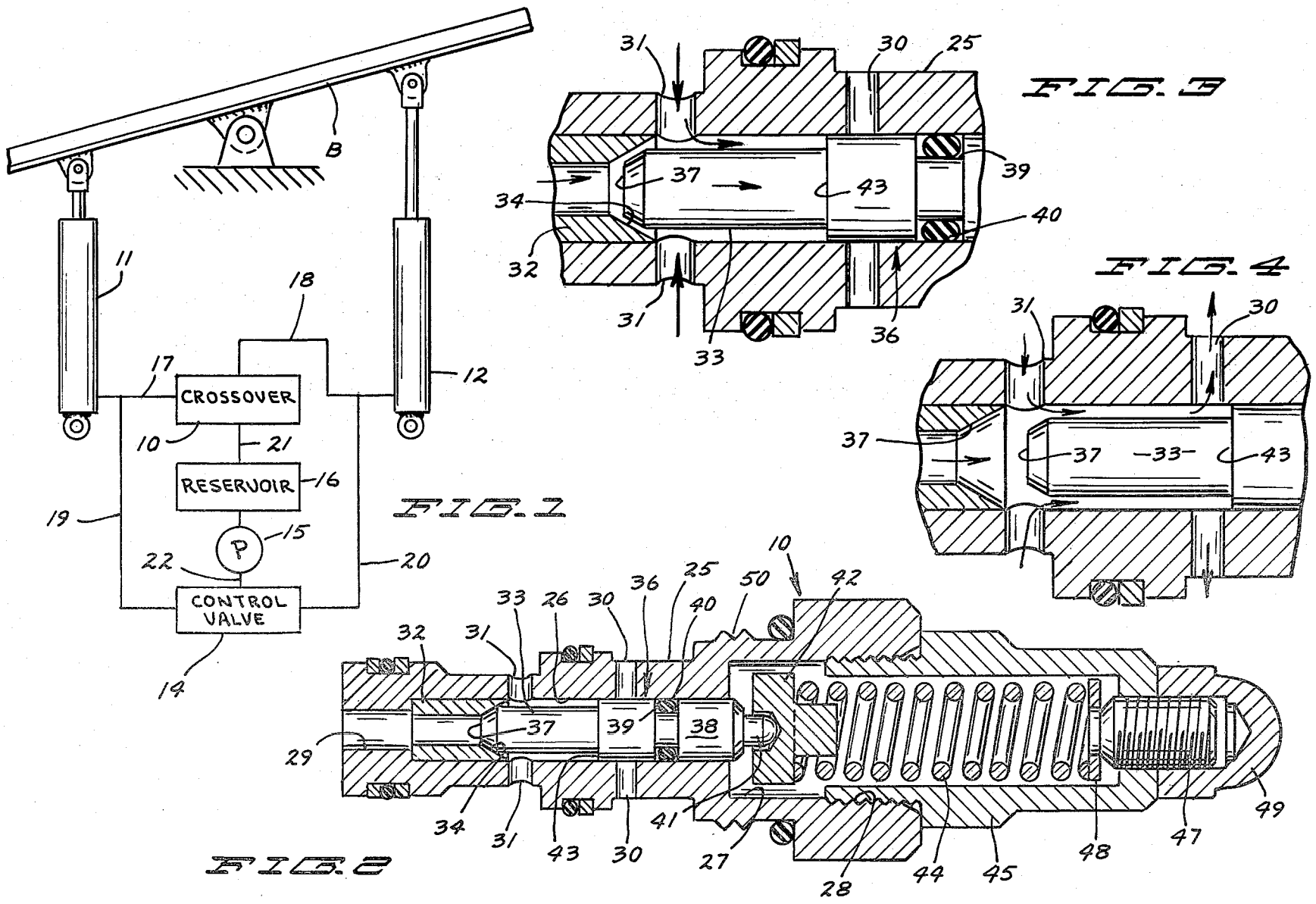
FIG. 1 is a schematic view of a snowplow mounting utilizing the crossover valve.
FIG. 2 is a longitudinal vertical section through the crossover valve in closed condition.
FIG. 3 is an enlarged fragmentary section of a portion of the valve shown encircled in FIG. 2 with the valve in partially open or crossover condition.
FIG. 4 is similar to FIG. 3 but showing the valve fully open to allow excess cylinder fluid to flow to the reservoir.

Referring now more particularly to the drawing reference characters will be used to denote like parts or structural features in the different views. In FIG. 1 there is shown the incorporation of a crossover valve, denoted generally at 10, in a hydraulic system used as a backing support for a plow blade B which is suitably supported on a motive vehicle or the like. The system includes single acting hydraulic jacks or cylinders 11 and 12 respectively connecting opposite end portions of blade B to the vehicle frame, a control valve 14, pump 15, and reservoir 16. Hydraulic lines 17 and 18 respectively connect the jacks 11 and 12 to valve 10 while lines 19 and 20 respectively connect lines 17 and 18 to the control valve 14. There are also connecting lines 21, from the valve 10 to reservoir 16 and 22, between the reservoir and control valve 14, with pump 15 disposed in the latter.

During operation hydraulic pressure is retained in the jacks 11 and 12 to retain blade B in the desired position of angular adjustment and to give backing support to the blade to perform its normal work. However, if one end of the blade should encounter an abnormal obstruction it is desirable that means be provided for allowing escape of a portion of the hydraulic fluid therefrom in order to prevent breakage or binding of the various mechanical components involved in the plow structure.

Frequently when one end of the blade B, such as the right side in FIG. 1, engages an immovable object so as to cause contraction of the jack 12 the blade will pivot about a central pivot causing the extension of jack 11. Accordingly fluid may pass from jack 12 through a crossover valve such as 10 into the extending jack 11. Just how this occurs will be understood by reference to FIGS. 2 and 3.

The crossover valve 10 has an elongated tubular body 25 with a passageway 26 extending axially therethrough. For the sake of convenience the right end of valve 10, as viewed in FIG. 2, will be referred to as the "closed" or "right" end while the other end of the valve will be referred to as the "open" or the "left" end of the valve. Adjacent the closed end of the valve the passageway 26 is enlarged to form a cylindrical chamber 27. The outer end of chamber 27 is internally threaded as at 28. The open or left end of the passageway 26 is slightly reduced in diameter to provide a port 29.

At about its longitudinal middle the body 25 is provided with diametrical ports 30 and similar diametrical ports 31 are provided intermediate ports 30 and the open end of the valve body. A sleeve 32 providing a tapered valve seat 34 fits tightly within passageway 26 adjacent port 29.

A valve piston denoted generally at 36 is slidably disposed for axial movement in passageway 26. Piston 36 has a frusto-conical shaped end with an end face 37 adapted to seat in tight substantially sealing engagement with the seat 34. The left end portion 33 of piston 36 is somewhat reduced in diameter to allow hydraulic fluid to enter that portion of passageway 26 surrounding piston portion 33. The righthand portion 38 of piston 36 has a close sliding fit within passageway 26 and is provided with a groove 39 for receiving sealing ring 40 and a shoulder 43 facing toward the end portion 33 of the piston. Shoulder 43 has the same area as end face 37.

At its righthand end the valve piston 36 has a centered projection 41. A spring support 42 fits onto projection 41 and seats one end of a spiral coil spring 44. A cylindrical valve head 45 has one end threaded into the internally threaded body portion 28 and provides a chamber for spring 44. A set screw 47 is threaded into the outer end of the head 45 and carries a washer 48 on its inner end which bears against the outer end of spring 44 to hold the spring under compression between support 42 and set screw 47. A cap 49 is threaded onto the outer end of the set screw 47. Various O-rings and backup rings are provided to encircle the valve body 25 to facilitate its mounting within a suitable housing as by the external threading at 50.

It will be understood that the piston 36 is yieldably retained in its far left or closed position, as shown in FIG. 2, by the compressive force of the spring 44. It will also be understood that this force or closing pressure may be selectively varied by adjustment of the set screw 47 in the head 45.

In connecting crossover valve into the hydraulic system the line 17 is connected to port 29, line 18 is connected to ports 31, while line 21 is connected to the ports 30.

In normal operation the valve 10 is in the condition shown in FIG. 2 with the piston 36 substantially blocking off any open communication between the lines 17, 18 and 21. The jacks 11 and 12 provide solid backing support for the ends of blade B during normal plowing operation. However, in the event that the right side of the blade should engage excessive resistance imparting a contracting force on jack 12, the pressure on the hydraulic fluid in the jack and line 18 will increase as will the pressure in port 31 and passageway 26 of the crossover valve. This increased pressure acting upon the face of shoulder 43 will urge the piston 36 to the right or toward the closed end of the valve against the compressive force of spring 44. This movement of piston 36 will unseat end face 37 thereof from seat 34 opening communication between port 31 and port 29. When jack 12 is forced to contract the jack 11 will tend to extend allowing the cylinder to receive additional hydraulic fluid. Thus the excessive pressure in jack 12 and line 18 will be relieved by a certain amount of the hydraulic fluid therein passing through ports 31, passageway 26, and port 29 into line 17 and jack 11. The pressure will thus be equalized between the two jacks.

This fluid crossover will be reversed in the event that excessive contracting force is applied to jack 11. In this case the pressure in line 17 will act upon the end face 37 of piston 36 to move it against spring 44 to allow passage of fluid from port 29 to port 31. Once the obstacle or resistance has been overcome and the piston 36 returns to its seated position against seat 34, the jacks 11 and 12 may be restored to their desired conditions of extension by operation of control valve 14. The crossover positions just described are shown in FIG. 3 of the drawing.

It will be understood that the setting for operation of the crossover valve may be varied by adjusting the set screw 47 to increase or reduce the compressive force of the spring 44 on the piston 36.

On certain occasions the contracting cylinder may exhaust more fluid than the extending cylinder can accept. This, of course, builds the pressure in both lines 17 and 18 and with such increased pressure acting upon both the piston and face 37 and the shoulder 43 the piston will be moved a sufficient distance against spring 44 to open the passageway 26 to the ports 30. The shoulder 43 moves past the edge of said ports as shown in FIG. 4. This permits the excess fluid to pass through port 30 and line 21 to the reservoir 16 until the excess pressure is reduced to the point where spring 44 returns the piston 36 to a closing position over port 30. When the pressures on blade B have been removed the cylinders 11 and 12 may both be returned to their normally extended condition through operation of control valve 14.

There is thus provided a relatively simple crossover valve for economically and effectively carrying out the aforementioned objectives. Having now therefore fully illustrated and described my invention, what I claim to be new and desire to protect by United States Letters Patent is:

1. A crossover relief valve for use in a hydraulic system having a pair of single acting hydraulic jacks and a reservoir which comprises, (a) an elongated tubular valve body having a passageway extending axially therethrough, the body forming a first port at one end of the passageway adapted to be connected for fluid communication with one of said jacks, (b) a closure means connected to the body closing the other end of the passageway, (c) a piston disposed for axial sliding movement in the passageway between closed, partially open and fully open positions, (d) a coil spring disposed within the passageway in compressed condition between the closure means and piston to yieldably retain the piston in a closed position over said first port, (e) the body having second and third ports in its tubular wall spaced different distances from the first port and both communicating with the passageway, said ports respectively adapted to be connected for fluid communication with the other jack and the reservoir, (f) the piston having a reduced portion between the first and second ports whereby, as the piston is displaced to a partially open position from a closed position, the first and second ports will have open communication through the passageway, and (g) said piston having a shoulder located between the second and third port when the piston is in closed position or in said partially open position providing a closure between the passageway and the third port but adapted to move past and open the third port to the passageway when the piston is moved to its open position, said shoulder having a surface facing away from the spring means which is exposed to fluid pressure in both the first and second ports when the piston is in partially open position.

2. The subject matter of claim 1 wherein the closure means comprises a cylindrical head for housing the spring with an adjustable set screw in its outer end for engaging against and adjusting the compressive force of the spring.

3. In a crossover relief valve for use in a hydraulic fluid system including a pair of single acting cylinders and a fluid reservoir, (a) an elongated valve body having a passageway extending axially therethrough and first, second and third ports spaced longitudinally along the body having open communication with the passageway and adapted to be respectively connected to the two cylinders and the reservoir, (b) a piston slidably disposed within the passageway for sliding movement axially of the passageway between a first position providing seals between the first and second port and the second and third port, a second position opening the first port to the second port through the passageway but still providing a seal between the second and third port, and a third position opening the first and second ports to each other and to the third port, (c) spring means yieldably retaining the piston in the first position, and (d) the piston being provided with surfaces exposed to the first and second ports responsive to increasing fluid pressures in said ports to move the piston against said spring means to the second and third positions.

4. In a crossover relief valve for use in a hydraulic fluid system including a pair of single acting cylinders and a fluid reservoir, (a) an elongated valve body having a passageway extending axially therethrough and first, second and third ports spaced longitudinally along the body having open communication with the passageway and adapted to be respectively connected to the two cylinders and the reservoir, (b) a piston slidably disposed within the passageway for sliding movement axially of the passageway between a first position providing seals between the first and second port and the second and third port, a second position opening the first port to the second port through the passageway but still providing a seal between the second and third port, and a third position opening the first and second ports to each other and to the third port, (c) spring means yieldably retaining the piston in the first position, (d) said ports being located in one end portion of the body member, the other end portion of the body member being closed by an axially adjustable screw member, and (e) said spring means being a spiral coil spring held under compression between the piston and the screw member.

* * * * *